US005681016A

United States Patent [19]

Wang

[11] Patent Number: 5,681,016

[45] Date of Patent: Oct. 28, 1997

[54] AUTOMATIC SUPPORT STAND FOR GOLF BAG

[76] Inventor: Jessie Li-Kuo Wang, 46980 Ocotillo Ct., Fremont, Calif. 94539

[21] Appl. No.: 533,615

[22] Filed: Sep. 25, 1995

[51] Int. Cl.[6] ..... A63B 55/00

[52] U.S. Cl. ..... 248/96; 248/346.01

[58] Field of Search ..... 248/96, 346.01

[56] References Cited

U.S. PATENT DOCUMENTS

| | | | |
|---|---|---|---|
| 5,147,089 | 9/1992 | Anderson | 248/96 |
| 5,156,366 | 10/1992 | Anderson | 248/96 |
| 5,236,085 | 8/1993 | Quellais | 248/96 |
| 5,351,921 | 10/1994 | Chen | 248/96 |
| 5,415,285 | 5/1995 | Reimers | 248/96 |
| 5,464,180 | 11/1995 | Cheng | 248/96 |

*Primary Examiner*—Leslie A. Braun
*Assistant Examiner*—Willie Berry, Jr.
*Attorney, Agent, or Firm*—Linval B. Castle

[57] ABSTRACT

An automatic support stand for golf bags includes two legs in a pivotal mount high on the bag which form a tripod with a flat bottomed pedal that is flush with the bottom surface of the bag but doesn't contact the bag. The pedal is hinged to a "L" shaped member that slides in a collar fixed to the bag side surface and raises a pair of resilient actuator rods attached to the legs jest below their pivotal mount

2 Claims, 3 Drawing Sheets

AUTOMATIC SUPPORT STAND FOR GOLF BAG

CROSS REFERENCE TO RELATED APPLICATION

This application is related to patent application 08/428,728, filed on Apr. 25, 1995 for Removable Automatic Tripod Legs for Golf Bags.

BRIEF SUMMARY OF THE INVENTION

This invention relates to golf equipment and particularly to tripod legs that automatically extend as a golf bag is tilted from a vertical position.

Two legs which are pivotable outward from positions high up on a golf bag are controlled by a pair of resilient rods that are forced upward from a pedal at ground level as the bag is tilted. This feature is common to both the present invention and to the golf bag described in copending application 08/428,728. In that prior golf bag the ground level pedal was not hinged and remained parallel with the bottom surface of the bag with the result that, when tilted, the bag was supported on three points: the two legs and the edge of the pedal, a position often less than desirable, especially on hilly, grass covered surfaces normally associated with golf courses.

The present invention also employs the two legs controlled by a pair of resilient rods that are forced upward from a pedal at ground level as the bag is tilted, But the pedal that moves the resilient rods is hinged in such a way that it's lower surface is in contact with the ground so that, when the bag is tilted, the bag is supported on two points and one relatively large flat lower pedal surface, thereby providing much greater stability of the bag on soft grass.

Briefly described the invention includes a pair of legs pivotally attached to a golf bag near the top surface thereof, said legs being extendible forward and outward by resilient actuating rods coupled to said legs and slideably anchored near the lower end of said bag, said rods being actuated by a free pedal pivotally coupled to the lower end of said bag.

DESCRIPTION OF THE DRAWINGS

In the drawings which illustrate the preferred embodiment of the invention.

DETAILED DESCRIPTION

Figure 1:
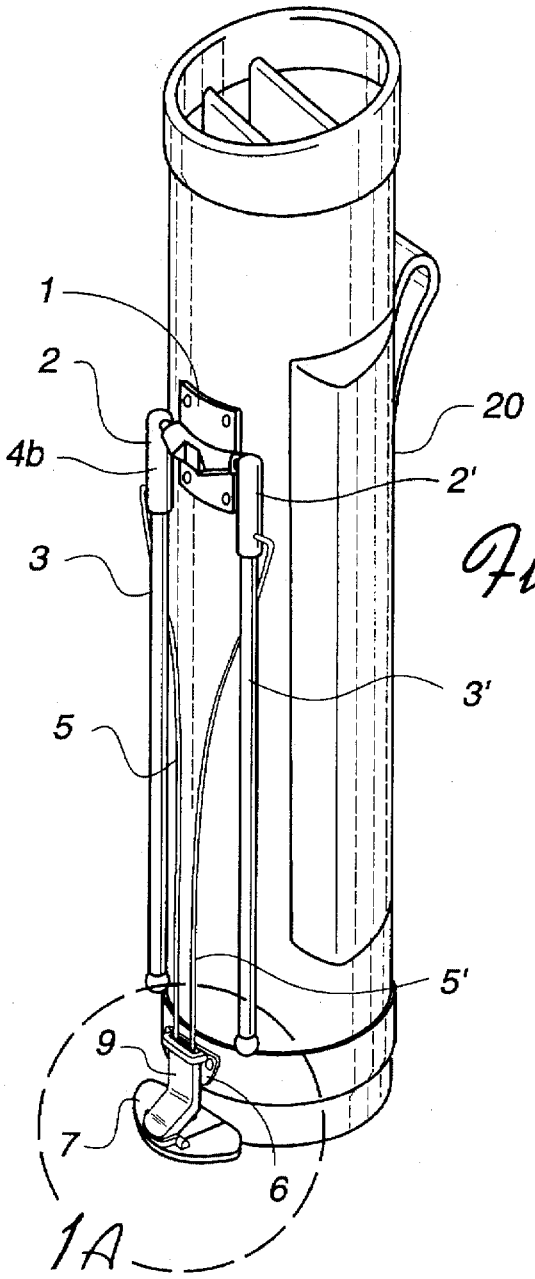
FIG. 1 is a perspective view of a golf bag equipped with the invention, the free pedal assembly being encircled.

FIG. 1 is a perspective view of a golf bag 20 having the automatic bag stand of the invention. In FIG. 1, an upper hinge bracket 1 is attached to the side of the bag about ten inches below the top edge of the bag. The hinge bracket 1 support pivotable members 2, 2' which may freely pivot forward and outward and which, in turn, support legs 3, 3' which generally extend to within about six inches of the bottom surface of the bag 20.

The legs 3, 3' are pivoted in and out by strong resilient actuating rods 5, 5' which are coupled to the members 2, 2' about three inches below the pivot points. The actuating rods are slideably coupled to the lower end of the bag by a restricting collar 6 located on a vertical line directly below the hinge bracket which normally holds the legs very close to the side of the bag. But by raising the actuating rods in the collar 6 a small amount, the rods force the legs to pivot outward. Conversely, lowering of the actuating rods 5, 5' will cause outward pivoted legs to return against the side of the bag.

Figure 1A:
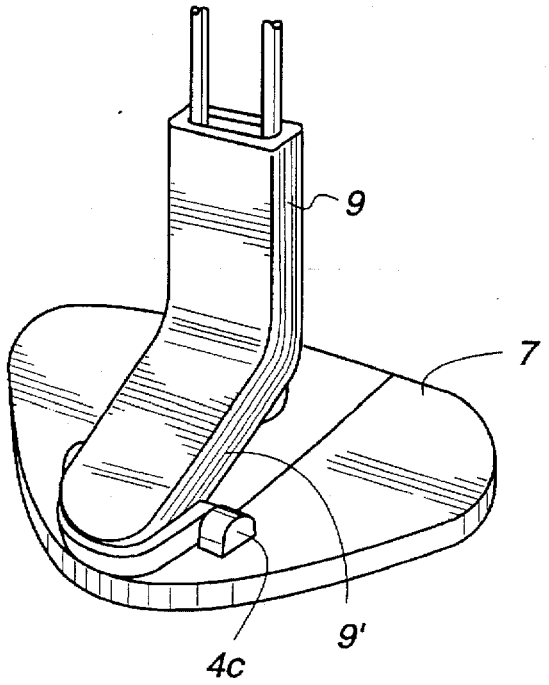
FIG. 1A is a perspective view of the free pedal assembly.

The mechanism for raising and lowering the actuating rods within the collar 6 is illustrated in the broken lines of FIG. 1 and is is illustrated in enlarged form in FIG. 1A.

In FIG. 1A the actuating rods are firmly attached to the vertical portion of an "L" shaped housing 9 which has parallel side walls so that it may slide in the collar 6. The opposite end of the housing 9, i.e. the toe of the base portion 9' of the "L" shaped housing, is hinged on an axis perpendicular to the parallel side walls to the free pedal 7 underlyine the base portion 9' by a hinge element 4C.

Figure 1B:
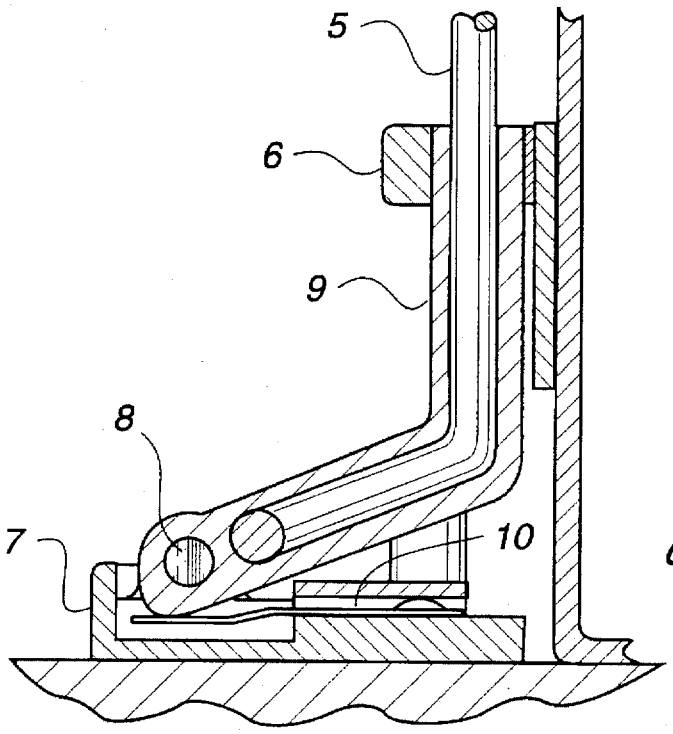
FIG. 1B is a sectional view of the free pedal assembly on a golf bag in a vertical position.
Figure 1C:
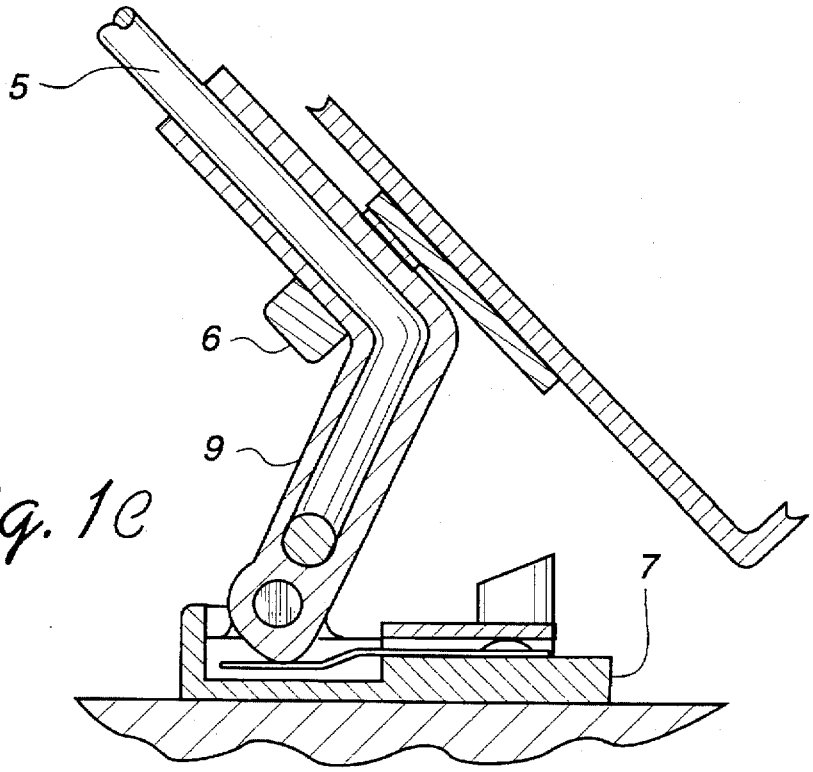
FIG. 1C is a sectional view of the free pedal assembly on a golf bag being tilted.

The sectional drawings of FIGS. 1B and 1C illustrate the operation of the mechanism for raising and lowering the actuating rods 5. FIG. 1B shows the actuating rods 5 on a golf bag that is vertically standing. The housing 9 is positioned low in the collar 6 which is firmly attached to the side surface of the bag, and the lower surface of the free pedal 7 stands on the surface of the ground parallel with, but not in contact with the lower surface of the bag. The figure shows a hinge pin 8 coupling the pedal 7 to the housing 9 and also a panel spring 10 installed parallel to the lower surface in the pedal 7 for cooperating with a flat portion of the cam 11 at the hinge end of the housing for maintaining the pedal 7 parallel with the lower surface of the bag while not contacting the ground, and for maintaining contact with the ground when the bag is placed on uneven surfaces.

When the golf bag 20 is vertically held on the ground, the pedal 7 is in contact with the ground and is positioned as illustrated in FIG. 1B with the housing 9 located at its lowest level with respect to the collar 6 which is attached to the golf bag.

Figure 2:
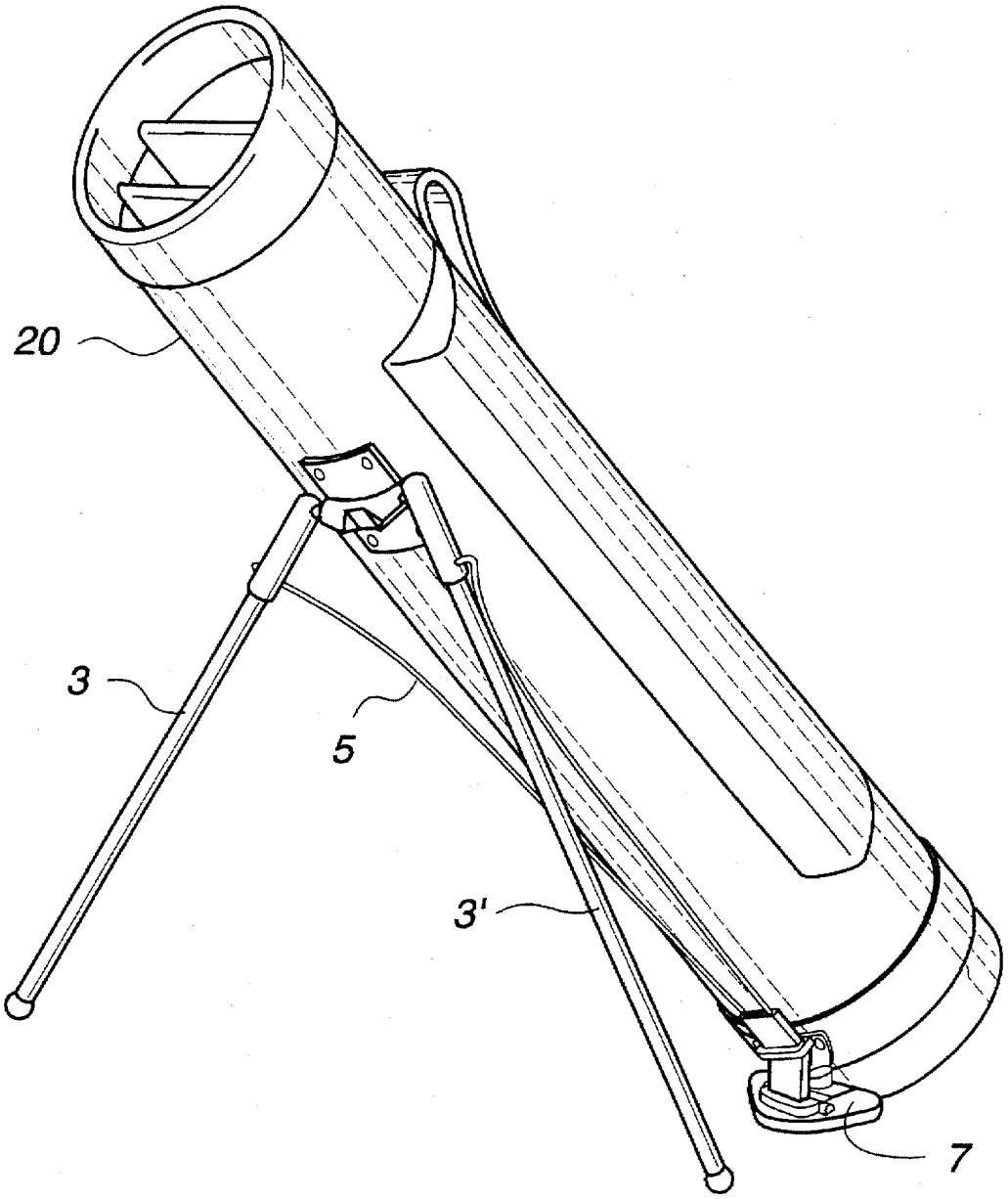
FIG. 2 is a perspective view of a golf bag standing on the support legs of the invention.

When the bag is tilted from that vertical position toward the retracted legs, the lower surface of the pedal remains on the ground but the housing 9 slides up in the collar 6 as the housing pivots on its hinge pin 8, as shown in FIG. 1C. This will force the actuating rods 5, 5' to drive the legs 3, 3' outward as shown in FIG. 2 to provide an automatic support stand for the golf bag.

When the golf bag is to be moved, it is only necessary to pick it up in the usual manner. At that time, the tendency of the resilient actuating rods 5, 5' to remain close to the bag will draw in the legs 3, 3' as shown in FIG. 1, and the panel spring 10 acting upon the fulcrum of the cam at the hinge end of the "L" shaped housing 9 will return the pedal to the position shown in FIG. 1B.

I claim:

1. A support stand for a golf bag comprising:

a hinge bracket secured to the upper side surface of the golf bag, said hinge bracket supporting pivotable elongated legs which may pivot forward and outward;

a collar secured to the lower side surface of said golf bag directly below said bracket;

an "L" shaped housing vertically slideable within said collar, the lower arm of said housing pointing in a direction away from said bag;

resilient actuating rods having a first end attached to said housing and a second end attached to said legs at points below the pivot, said actuating rods being normally forced against the side surface of said golf bag by said collar;

a pedal having a flat lower surface, said pedal being hinged to the end of the lower arm of said housing and underlying said housing for vertically sliding said "L" shaped housing in said collar and vertically moving said actuating rods to extend said legs; and spring means within said pedal said spring means acting upon a cam at the hinge end of said housing for returning said pedal to a normal horizontal position.

2. The support stand claimed in claim 1 wherein said spring means is a panel spring in said pedal positioned substantially parallel to said lower surface of said pedal.

* * * * *